US006234331B1

(12) United States Patent
Brandenberg

(10) Patent No.: US 6,234,331 B1
(45) Date of Patent: May 22, 2001

(54) APPARATUS FOR SUPPORTING MODULAR AND COOPERATING COMPONENTS

(76) Inventor: Carl Brock Brandenberg, FM 3450, Box 188, Cresson, TX (US) 76035

( * ) Notice: Subject to any disclaimer, the term of this patent is extended or adjusted under 35 U.S.C. 154(b) by 0 days.

(21) Appl. No.: 08/946,445

(22) Filed: Oct. 7, 1997

Related U.S. Application Data

(63) Continuation-in-part of application No. 08/786,325, filed on Jan. 23, 1997, now Pat. No. 5,746,334, which is a continuation of application No. 08/157,949, filed on Nov. 24, 1993, now abandoned.

(51) Int. Cl.[7] ..... A47B 43/00
(52) U.S. Cl. ..... 211/205
(58) Field of Search ..... 211/26, 205, 129.1, 211/182, 131.1, 144; 248/121, 122, 125, 288.5, 407, 413, 415, 416, 418, 412, 917, 924, 282, 283; 403/113, 116, 117, 112, 362, 378

(56) References Cited

U.S. PATENT DOCUMENTS 1,409,609 * 3/1922 Stockle ..... 248/125
3,458,234 * 7/1969 Bates ..... 248/125
3,637,179 * 1/1972 Marschak ..... 211/205 X
4,666,118 * 5/1987 Busche ..... 248/288.5
5,117,806 * 6/1992 Soat ..... 248/125 X

* cited by examiner

*Primary Examiner*—Alvin Chin-Shue
*Assistant Examiner*—Sarah L. Purol
(74) *Attorney, Agent, or Firm*—Melvin A. Hunn

(57) ABSTRACT

An apparatus for supporting modular and cooperating components which includes a base assembly, a work surface, a vertical support pole extending upward from the work surface, at least one bushing concentrically engaging the vertical support pole at a particular axial location, at least one support arm extending radially outward from the bushing, and at least one support surface secured to the support arms in a position substantially orthogonal to the support pole, which minimizes the space requirements for supporting modular and cooperating components, particularly in an office environment. The support apparatus according to the present invention increases the functionality of the modular and cooperating components without exposing the modular and cooperating components to unnecessary risk of harm.

44 Claims, 16 Drawing Sheets

APPARATUS FOR SUPPORTING MODULAR AND COOPERATING COMPONENTS

CROSS-REFERENCE TO RELATED APPLICATION

This application is a continuation-in-part of application Ser. No. 08/786,325, filed 23 Jan. 23 1997, now U.S. Pat. No. 5,746,334, entitled Apparatus for Supporting Modular and Cooperating Components, which is a continuation under 37 CFR 1.62 of Ser. No. 08/157,949, filed Nov. 24, 1993, abandoned, which is incorporated herein by reference as if fully set forth.

BACKGROUND OF THE INVENTION

1. Field of the Invention

The present invention relates in general to techniques for arranging and supporting modular, cooperating components such as, for example but not limitation, computing equipment, audio equipment, and video equipment.

2. Description of the Prior Art

Recent rapid advances in the computing industries have been driven largely by a reduction in the price of both processing power and computer memory. One result in the increased availability of inexpensive computing equipment is a tremendous increase in consumer demand for modular computing equipment, such as computers, computer displays, printers, and peripheral devices such as tape back-up devices and CD ROM devices. There appears to be an increased integration of computing equipment with traditional audio-visual entertainment devices, such as tuners, amplifiers, equalizers, video cassette recorders, laser discs, CD audio players, CD video players, and display screens of all types.

The computing equipment, audio equipment, and video equipment is still rather expensive and delicate, so conventional cabinet work is frequently utilized for supporting these modular components in the safest possible manner. However, the increased integration of computing equipment, audio equipment, and video equipment necessarily requires increased electrical connectivity between such devices, and it is not uncommon for an operator to frequently reconfigure devices to accomplish a particular short-term goal with such modular equipment. Traditional equipment supporting furniture does not allow easy access to all sides of the modular equipment, in particular the back portions of the modular equipment, and thus frustrates operator-initiated attempts to reconfigure the modular components for a particular purpose however, since the modular components are still relatively expensive, exposing them to unnecessary risk of damage is generally not considered to be an acceptable risk when compared to the temporal needs of a particular operator.

A need exists for a support apparatus for utilization with modular cooperating components, such as computing equipment, audio equipment, and video equipment, which enhances the overall coordinated functionality of these components without unnecessarily exposing the modular components to risk of damage.

SUMMARY OF THE INVENTION

It is one objective of the present invention to provide an apparatus for supporting modular and cooperating components which includes a base assembly, a substantially planar work surface with a port formed therein, and a vertical support pole extending upward through the port in the work surface, at least one bushing concentrically engaging the vertical support pole at a particular axial location, at least one support arm extending radially outward from the bushing, and at least one support surface secured to the support arms in a position substantially orthogonal to the support pole, which minimizes the space requirements for supporting modular and cooperating components, particularly in an office environment. The support apparatus according to the present invention increases the functionality of the modular and cooperating components without exposing the modular and cooperating components to unnecessary risk of harm.

In accordance with the preferred embodiment of the present invention, the base assembly includes a number of frame segments which cooperate to fully support the load of the vertical support pole and any associated modular and cooperating components which are carried by the vertical support pole. In accordance with the preferred embodiment of the present invention, the substantially planar work surface does not carry the load of either the vertical support pole or the modular and cooperating components which are carried by the vertical support pole. Accordingly, the substantially planar work surface may be formed of any conventional or unconventional material. For example, the substantially planar work surface may be formed from glass or from a fairly brittle stone. This is allowed due to the fact that the substantially planar work surface is not a load bearing surface. It is bolted into place relative to the base assembly. All the loads associated with the vertical support pole and the modular and cooperating components are carried solely by the base assembly.

In accordance with the preferred embodiment of the present invention, the base assembly is comprised of a plurality of modular corner frame members, a plurality of horizontal tie bars which interconnect the plurality of modular corner frame members, and a pole receptacle member which is coupled to a particular one of the modular corner frame members. In accordance with the particular embodiment discussed herein, each of the modular corner frame members are formed from an upper horizontal frame member, a lower horizontal frame member and first and second spaced apart vertical frame members. In accordance with the preferred embodiment, the upper and lower horizontal frame members are spaced apart from one another a predetermined distance. The first and second spaced apart vertical frame members extend between the upper and lower horizontal frame members. Preferably, the upper horizontal frame member includes first and second generally orthogonally positioned framed segments. Likewise, the lower horizontal frame member includes first and second generally horizontal frame segments. Preferably, the first and second generally orthogonal positioned frame segments come together at an apex portion. Additionally, and in accordance with the preferred embodiment of the present invention, the vertical frame members extend between the upper and lower horizontal frame members at locations distally located from the apex portion of the upper and lower horizontal frame members, allowing relatively unrestricted access to the substantially vertical support pole. This is advantageous in that it allows for particular ones of the modular and cooperating components to be placed on a support arm located underneath the substantially planar work surface. For example, one may want a central processing unit of a personal computer to be located underneath the work surface, while the keyboard and monitor are located on or above the substantially planar work surface.

In accordance with the preferred embodiment of the present invention, the plurality of modular corner frame members include a predetermined number of end portions with connection ports formed therein. The plurality of horizontal tie bars terminate in connection members which releasably mechanically couple with the connection ports of the plurality of modular corner frame members. Preferably, the plurality of horizontal tie bars and the plurality of modular corner frame members do not require positive mechanical locks therebetween during ordinary use.

In accordance with the preferred embodiment of the present invention, the pole receptacle member includes a pair of generally orthogonal connection flanges which are adapted in size to extend between particular orthogonal portions of a particular modular corner frame member. A plate member extends between the generally orthogonal connection flanges. A vertically-lined pole sleeve is coupled to (and through) the plate member. The pole sleeve includes a central bore adapted in size and shape to receive the substantially vertical support pole.

The preferred embodiment of the support apparatus of the present invention further includes at least one bushing, which concentrically engages the substantially vertical support pole at a particular axial location. Preferably, a plurality of bushings are provided, each disposed at a particular axial location relative to the substantially vertical support pole. Each bushing is rotatable relative to the vertical support pole, but preferably over a predetermined rotation range.

Preferably, each bushing includes a hub portion which includes a central bore for concentrically receiving the vertical support pole, a hub pin for maintaining the hub portion in a fixed axial position relative to the vertical support pole, and a bushing insert which is carried within the hub portion, and which includes a particular contoured portion which defines the range of rotation of the particular bushing relative to the base member. More particularly, the bushing insert is adapted to be positioned within the hub portion in a particular orientation the lowermost portion of the bushing insert extends outwardly of the bushing, and is contoured to provide a surface which slidably engages the hub pin over the predetermined range of rotation. Typically, the region which slidably engages the hub pin is defined by stop members. This contoured configuration is typically referred to as "castellation".

In the preferred embodiment of the present invention, the hub pin includes an eyelet portion which is adapted for receiving and securing conductors which extend between the modular and cooperating components. The hub pin also includes a load bearing portion (preferably the shaft portion of an eye-bolt) for engaging the lowermost portion of the hub, and in particular the bushing insert. The hub pin and hub portion engagement serves two functions simultaneously. First, it prevents downward axial displacement of the bushing. Second, it limits the range of rotation depending upon the particular configuration of the base member, as was discussed above. The hub pin thus simultaneously serves three important functions in the present invention.

In the preferred embodiment of the present invention, a plurality of bushing station ports are provided which extend through the vertical support pole, and which define a plurality of possible axial positions for engagement of bushings. In accordance with the present invention, the orientation of the bushing station ports corresponds to the particular base member provided. In other words, bushing station ports are provided at particular positions which ensure that the modular and cooperating components are maintained within the range of support provided by the particular leg configuration of the base member.

In the preferred embodiment of the present invention, the hub pin is externally threaded at the end opposite the eye portion. A hub pin retainer member is provided, which includes an externally threaded portion, which couples to the hub pin and prevents inadvertent removal of the hub pin.

The support apparatus of the present invention further includes at least one support surface, each of which is secured to a corresponding cantilevered support arm which extends radially outward from a particular bushing. Preferably, the support arms are orthogonal to the substantially vertical support pole. Loads are applied normal to the support surface and associated support arm. Preferably, the support surfaces are positioned substantially orthogonal to the support pole and are adapted for receiving and supporting the modular and cooperating component's particular axial and angular positions relative to the base member and the substantially vertical support pole In the preferred embodiment of the present invention, each particular support surface is pivotally coupled to a selected support arm. Preferably, this support surface comprises a single piece of relatively low profile but sturdy material, such as an aluminum sheet. The pivotal coupling between the support surface and the support arm preferably comprises a coupling bore which extends through the support surface (for sturdy support surfaces, such as wooden support surfaces) at a central location, and a coupling pin which extends to the coupling bore and which serves to secure the support surface to the support arm or into a fastening plate or bracket (for less sturdy support surfaces, such as wooden support surfaces). This coupling allows for full 360° rotation of the support surface, to allow any orientation of the modular components that is required by the operator. In the preferred embodiment of the present invention, a locking member is provided for fixing the rotational orientation of the support surface relative to the support arm. Additionally, male and female mating members are provided between the support surface and the support arm for slightly impeding rotational movement, and especially for impeding vibration-induced rotational movement, which is frequently present during the operation of such components as impact printers.

Additional objectives, features and advantages of the present invention will be apparent with reference to the detailed description which follows.

BRIEF DESCRIPTION OF THE DRAWINGS

The novel features believed characteristic of the invention are set forth in the appended claims. The invention itself, however, as well as a preferred mode of use, further objectives and advantages thereof, will best be understood by reference to the following detailed description of an illustrative embodiment when read in conjunction with the accompanying drawings, wherein:

DETAILED DESCRIPTION OF THE INVENTION

Figure 1:
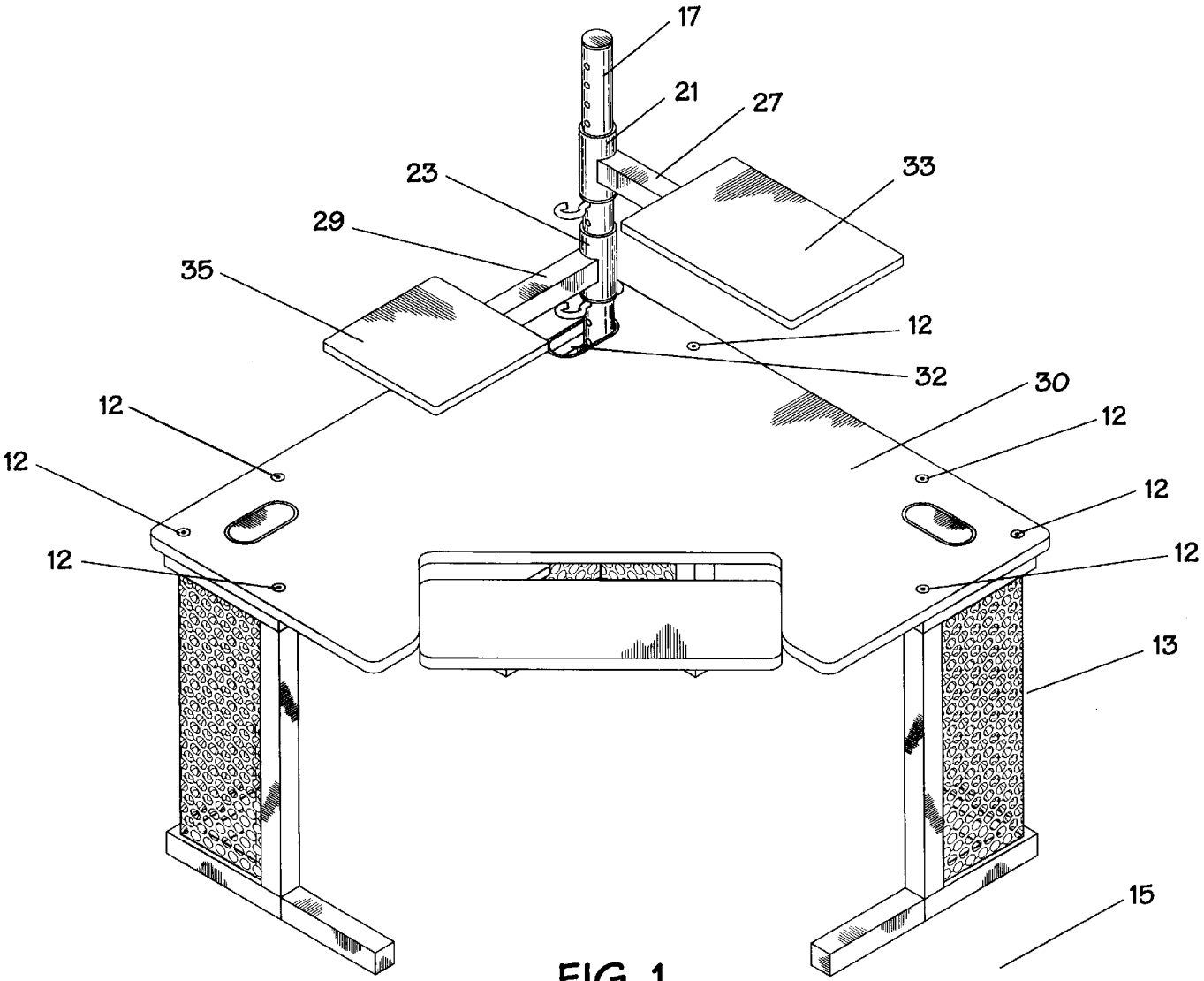
FIG. 1 is a perspective view of one particular embodiment of the support apparatus of the present invention.

FIG. 1 is a perspective view of one embodiment of support apparatus 11 of the present invention. As is depicted therein, support apparatus 11 includes base assembly 13 which is adapted for engaging a flooring surface 15 and a substantially vertical support pole 17. A plurality of bushings 21, 23, each concentrically engage vertical support pole 17 at a particular axial location. A plurality of support arms 27, 29 extend radially outward from bushings 21, 23 at particular orientations relative to one another, and a plurality of support surfaces 33, 35 are secured to the support arms 27, 29, respectively, and are positioned substantially orthogonal to the vertical support pole and adapted for receiving and supporting modular and cooperating components at particular axial and angular positions relative to base assembly 13 and vertical support pole 17.

A substantially planar work space 30 is secured to base assembly 13 through a plurality of bolts or screws 12. A support pole port 32 extends through a predetermined portion of substantially planar work space 30. Substantially planar work space 30 does not support any of the loads associated with vertical support pole 17 or any of the modular and cooperating components which may be carried thereon. A receptacle member (concealed in the new FIG. 1) carried the entire mechanical load of vertical support pole 17 and distributes it directly to base assembly 13. This load can be considerable.

Figure 2:
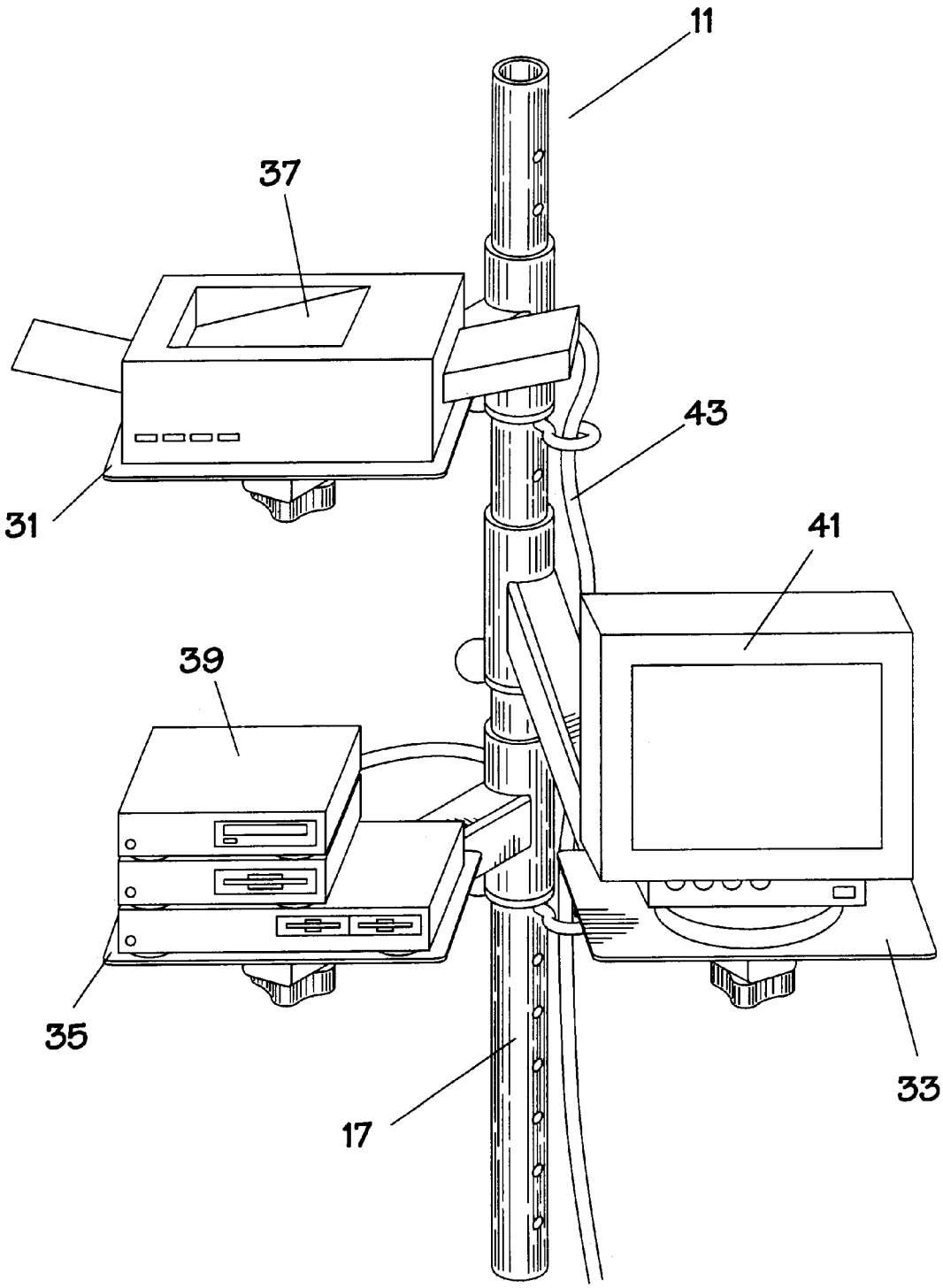
FIG. 2 is a pictorial representation of the pole portion of the support apparatus of the present invention equipped with modular computing equipment.

FIG. 2 depicts a portion of vertical support pole 17 of FIG. 1, with an additional bushing 19, support arm 25, and support surface 31, supporting modular computing equipment. As is shown, printer 37 is disposed on support surface 31 at a particular axial and angular position relative to base assembly 13 and vertical support pole 17. Central processing unit and associated mass memories 39 are supported by support surface 35 in a particular and angular position relative to base assembly 13 and vertical support pole 17. Monitor 41 is supported by support surface 33 at a particular axial and angular position relative to base assembly 13 and vertical support pole 17. Cabling 43 extends between the modular and cooperating components which make up the data processing system depicted in FIG. 2. The present invention is not intended to be limited for utilization in supporting components of a data processing system, and is intended to support all types of modular and cooperating components, including audio components and video components. The present invention may be utilized to support a combination of computing, audio, and video components in a particular location, with subgroupings of these components comprising cooperating components, and with not all of the components cooperating together.

Figure 3:
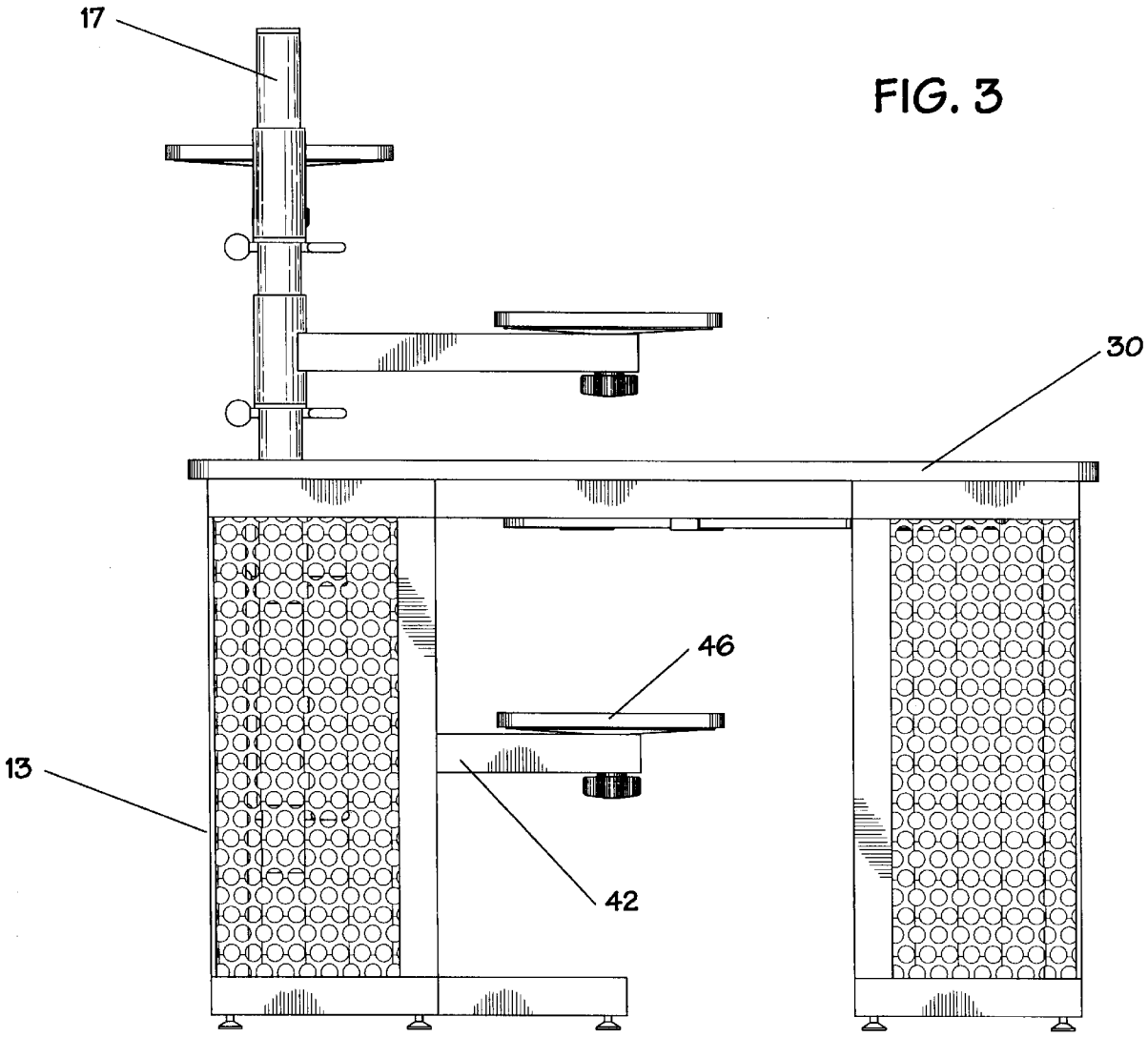
FIG. 3 is a side view of the embodiment of the support apparatus of the present invention depicted in FIG. 1.

FIG. 3 is a side view of the particular embodiment of the support apparatus depicted in FIG. 1. As is shown, vertical support pole 17 may extend any predetermined distance below substantially planar work surface 30, and may be utilized to support one or more support arms and support surfaces, such as support arm 42 and support surface 46 in order to maintain any particular component of the modular and cooperating components in a substantially concealed position beneath substantially planar work surface 30. One particular application of this is the positioning of a central processing unit beneath substantially planar work surface 30, while the keyboard monitor and other input/output devices are maintained above substantially planar work surface 30 and supported by substantially vertical support pole 17.

Figure 4:
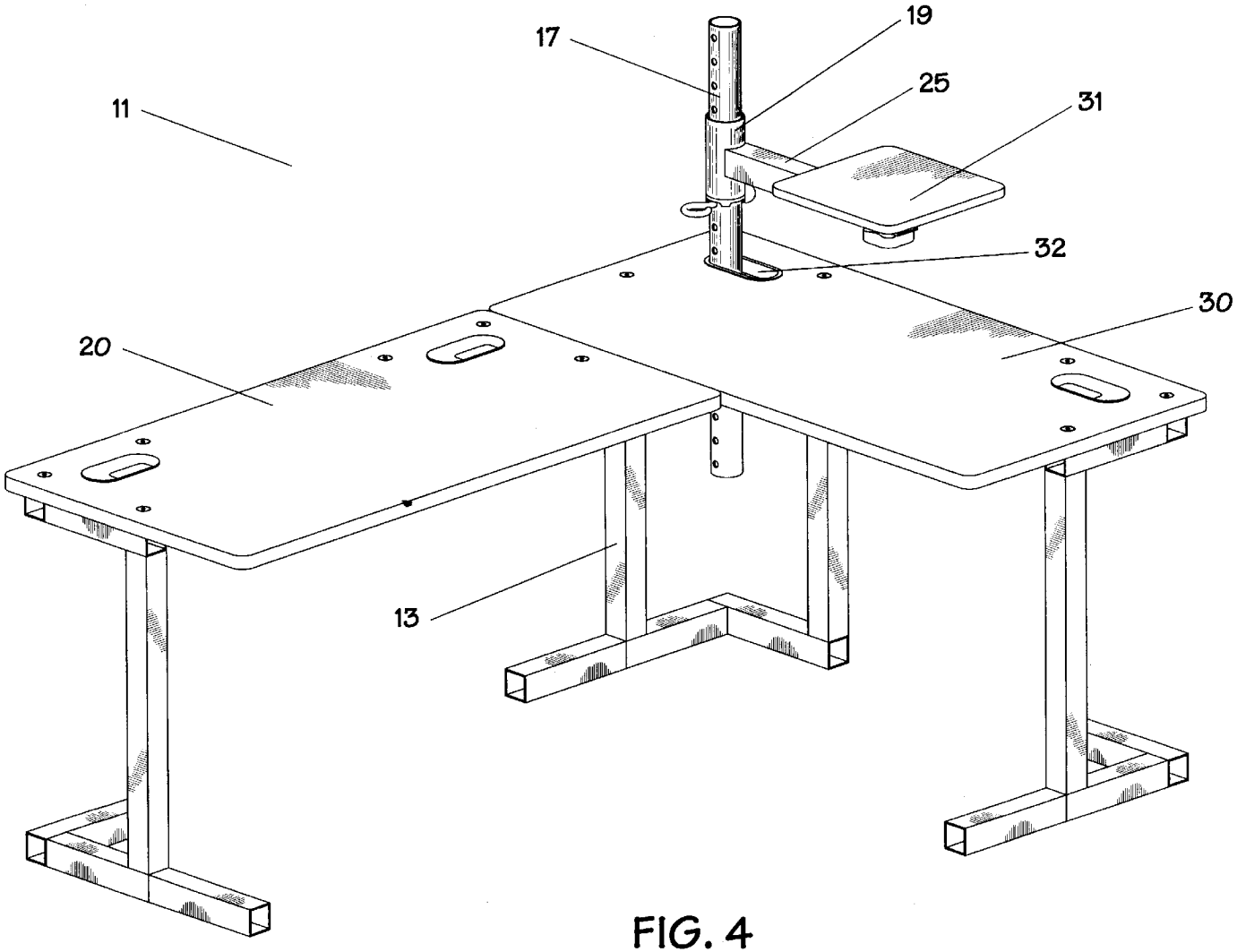
FIGS. 4, 5 and 6 depict an alternative embodiment of the support apparatus of the present invention, with FIG. 5 depicting the apparatus of FIG. 4 with the work surfaces removed, with FIG. 6 depicting the support apparatus with the work surface removed and with the frame member components in fragmentary exploded view.
Figure 5:
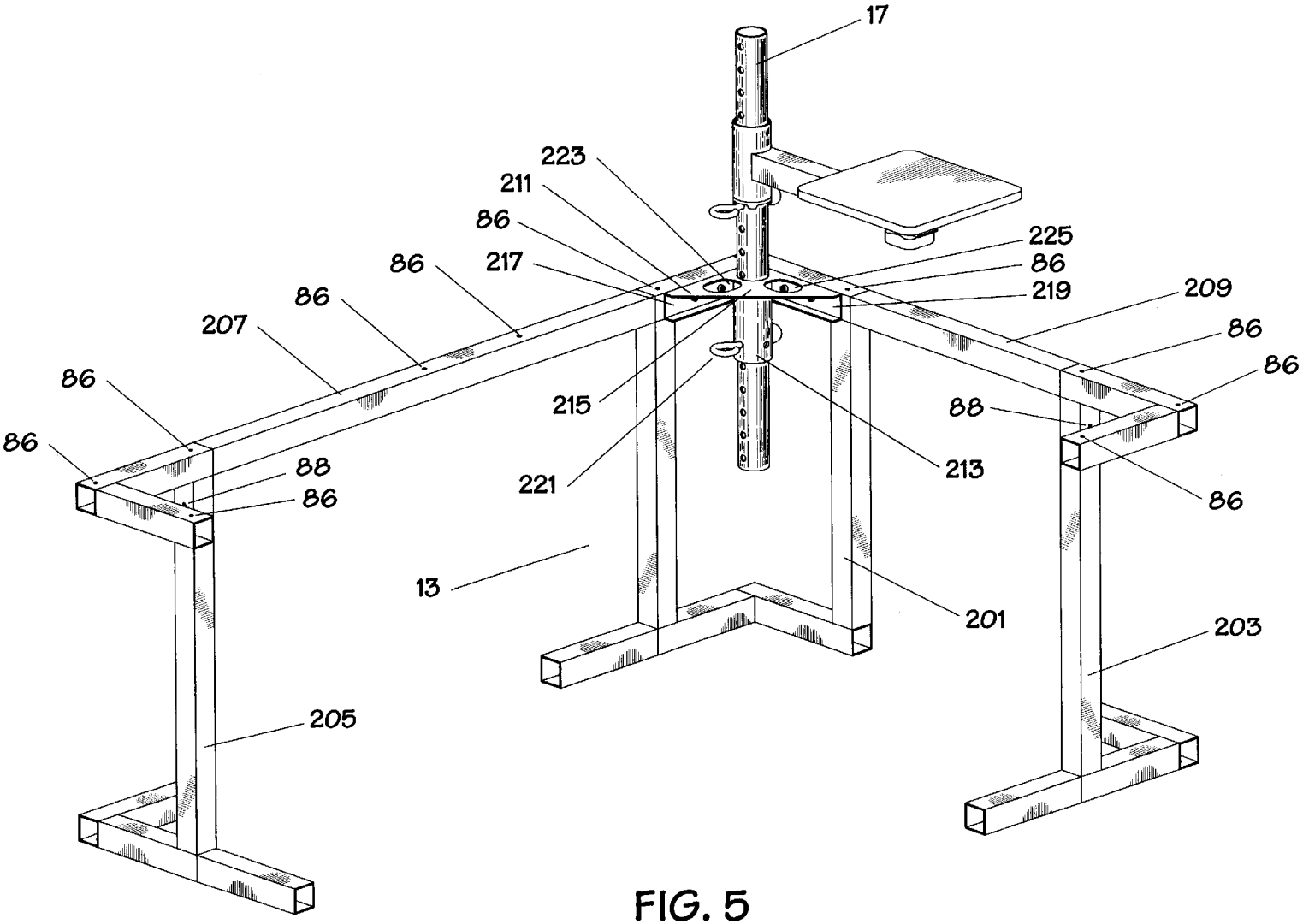
Figure 6:
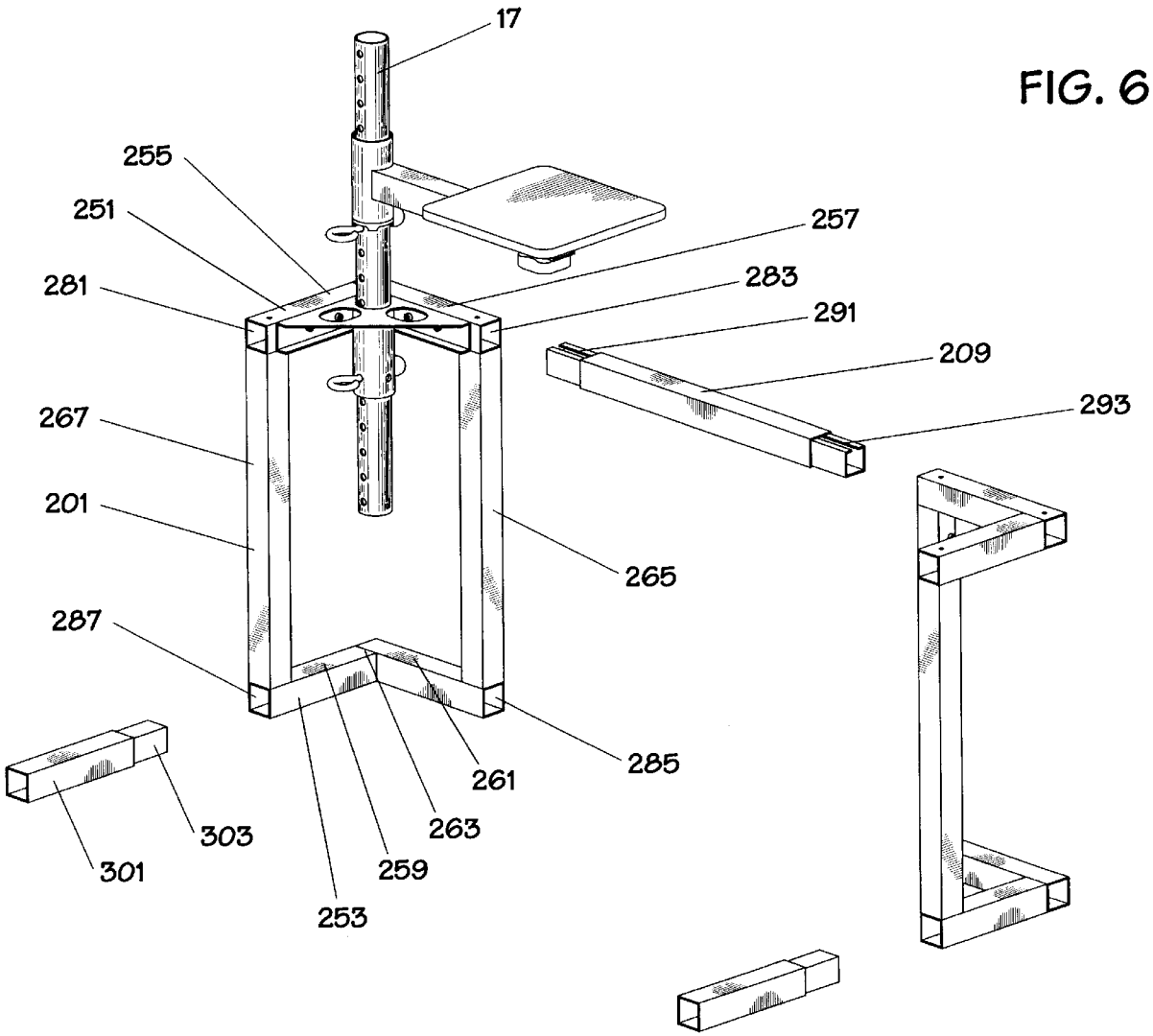

FIGS. 4 through 6 will now be utilized to illustrate various mechanical features and components utilized in the support apparatus of the present invention.

FIGS. 4 and 5 depict one particular embodiment of the support apparatus, with FIG. 4 depicting the apparatus with substantially planar support surfaces in place, while FIG. 5 depicts the same apparatus of FIG. 4 but with the substantially planar support surfaces removed to illustrate various mechanical features and components of the support apparatus.

With reference first to FIG. 4, support apparatus 11 includes a base assembly 13, substantially planar support surfaces 20, 30, a plurality of support pole ports extending at various locations through substantially planar work surfaces 20, 30, and substantially vertical support pole 17 extending through a particular support pole port 32, and having one or more bushings 19, support arms 25 and support surfaces 31 coupled thereto. In the view of FIG. 4, a single support arm 25 is depicted for purposes of simplicity. In practice, a plurality of support arms are secured to vertical support pole 17 to locate particular modular and cooperating components relative to one another.

FIG. 5 is a pictorial representation of the embodiment of the support apparatus 11 of FIG. 4, but with work surfaces 20, 30 removed to allow exposition and depiction of the various mechanical features and components. As is shown, base assembly 13 is composed of a plurality of horizontal and vertical components which cooperate together to support the substantially planar work surfaces and to support the loads associated with the substantially vertical support pole 17 and the modular and cooperating components which are carried thereon. As is shown, a plurality of modular corner frame members 201, 203, 205 are provided. The plurality of modular corner frame members 201, 203, 205 are interconnected with a plurality of horizontal tie bars such as horizontal tie bars 207, 209. Modular corner frame member 201 is permanently connected to pole receptacle member 211. Pole receptacle member 211 includes a substantially vertical and cylindrical pole sleeve 213 which is adapted in size and shape to receive substantially vertical pole 17. Preferably, the lower portion of pole sleeve 213 is adapted with ports to allow for connecting pin 221 to be passed through ports provided in substantially vertical poles 17 to fix the relative vertical position of substantially vertical pole 17 relative to base assembly 13. In accordance with the preferred embodiment of the present invention, a variety of adjustment holes are provided within substantially vertical pole 17 to allow for the raising and lower of substantially vertical pole 17 relative to base assembly 13. Additionally, pole receptacle member 211 includes a metal plate 215 which is permanently secured to pole sleeve 213 (preferably by weldment). Plate 215 is generally triangular in shape, and has its left and right ends formed into flanges 217, 219 which are adapted to be screwed into position relative to frame assembly 13. Together, modular corner frame member 201, pole receptacle member 211 and substantially vertical pole 17 provide a rigid, inflexible, and load bearing structure which passes the loads associated with substantially vertical pole 17 at any modular and cooperating components carried thereon throughout frame assembly 13. The substantially planar work surfaces coupled to the upper surface of base assembly 13 (preferably by screws or bolts at screw holes 86) is not a load bearing surface with respect to the loads carried by substantially vertical support pole 17. As is shown in the view of FIG. 5, plate member 215 further includes cable ports 223, 225 which are generally orthogonally aligned with pole sleeve 213, and which are adapted to be in alignment with the pole port provided in the substantially planar work surface. Cables for the modular and cooperating components may be passed through either of ports 223, 225 and the pole port in the substantially planar surface which is directly above either of these. Modesty panels may be secured to the base assembly 13 by bolts or screws at the screw holes 88 which are shown in phantom.

FIG 6 is a fragmentary and exploded view of a portion of the base assembly of FIG. 5. In particular, in FIG. 6, the relationship between modular corner frame member 201 and the other portions of base assembly is illustrated. As is shown, modular corner frame member 201 includes upper horizontal frame member 251 and lower horizontal frame member 253. Additionally, modular corner frame member 201 includes first and second spaced apart vertical frame members 265, 267. As is shown in the view of FIG. 6, upper horizontal frame member 251 includes substantially orthogonally positioned frame segments 255, 257 which come together at an apex (which is obstructed within the view of FIG. 6 by substantially vertical support pole 17). Likewise, lower horizontal frame member 253 includes first and second generally orthogonally positioned frame segments 259, 261, which come together at apex 263. In accordance with the preferred embodiment of the present invention, the first and second spaced apart vertical frame members 265, 267 are located distally from the apexes of the upper and lower horizontal frame members. This allows relatively unrestricted access to the substantially vertical support pole 17 from underneath the substantially planar work surface. Additionally, this allows support arms to be suspended from substantially vertical support pole from beneath the substantially vertical work surface in any location exterior of the base assembly between an arc defined between first and second spaced apart vertical frame members 265, 267 which spans (in the preferred embodiment) 270°. The advantage of this relative unrestricted access is depicted in the configuration depicted in FIG. 7*b* which will be discussed below.

As is shown in FIG. 6, the modular corner frame member 201 include a predetermined number of end portions with connection ports 281, 283, 285, 287 formed therein. These connection ports are utilized for connection to the horizontal tie members, such as horizontal tie member 209. As is shown, the connection ports 281, 283, 285, 287 are square (in the preferred embodiment) and sized in a manner which adapts to the male end pieces 291, 293 of horizontal ties such as horizontal tie 209. The male members simply slide in position within the connection ports. No screws, bolts or other mechanical positive locks are required. Also shown in the fragmentary view of FIG. 6, horizontal tie member 301 is shown with male connector 303 adapted for insertion in connection port 287.

Figure 7A:
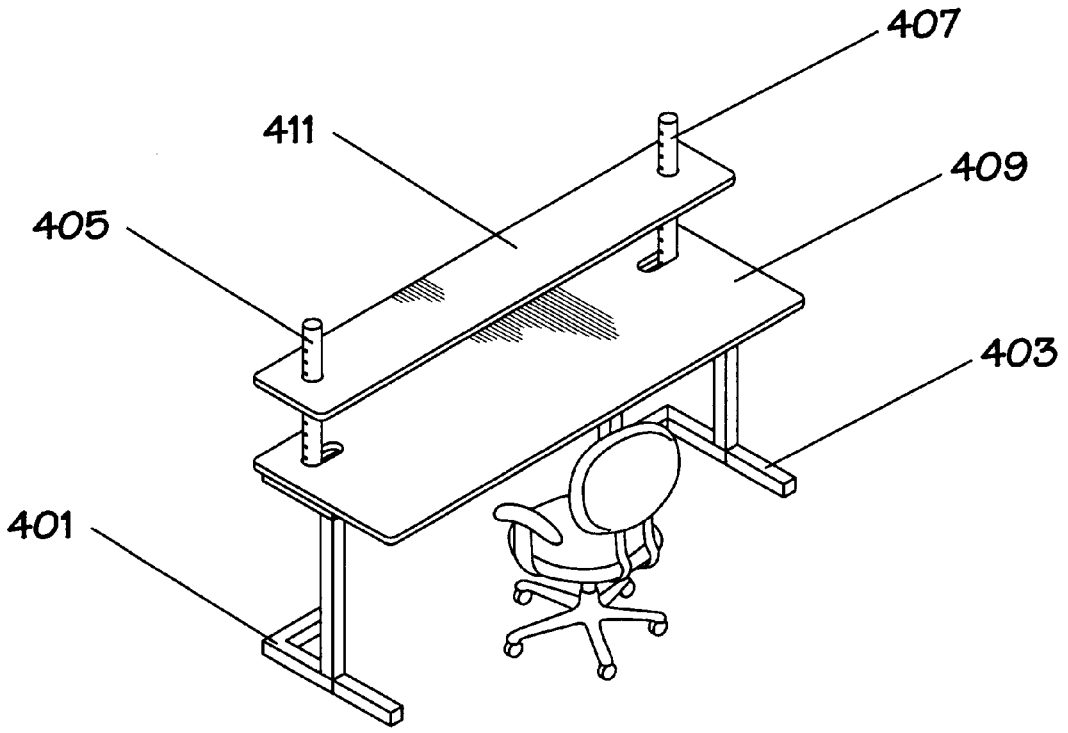
FIGS. 7*a*, 7*b*, and 7*c* depict alternative support devices in accordance with the present invention and generally demonstrate the modularity and configurability of the support apparatus of the present invention.
Figure 7B:
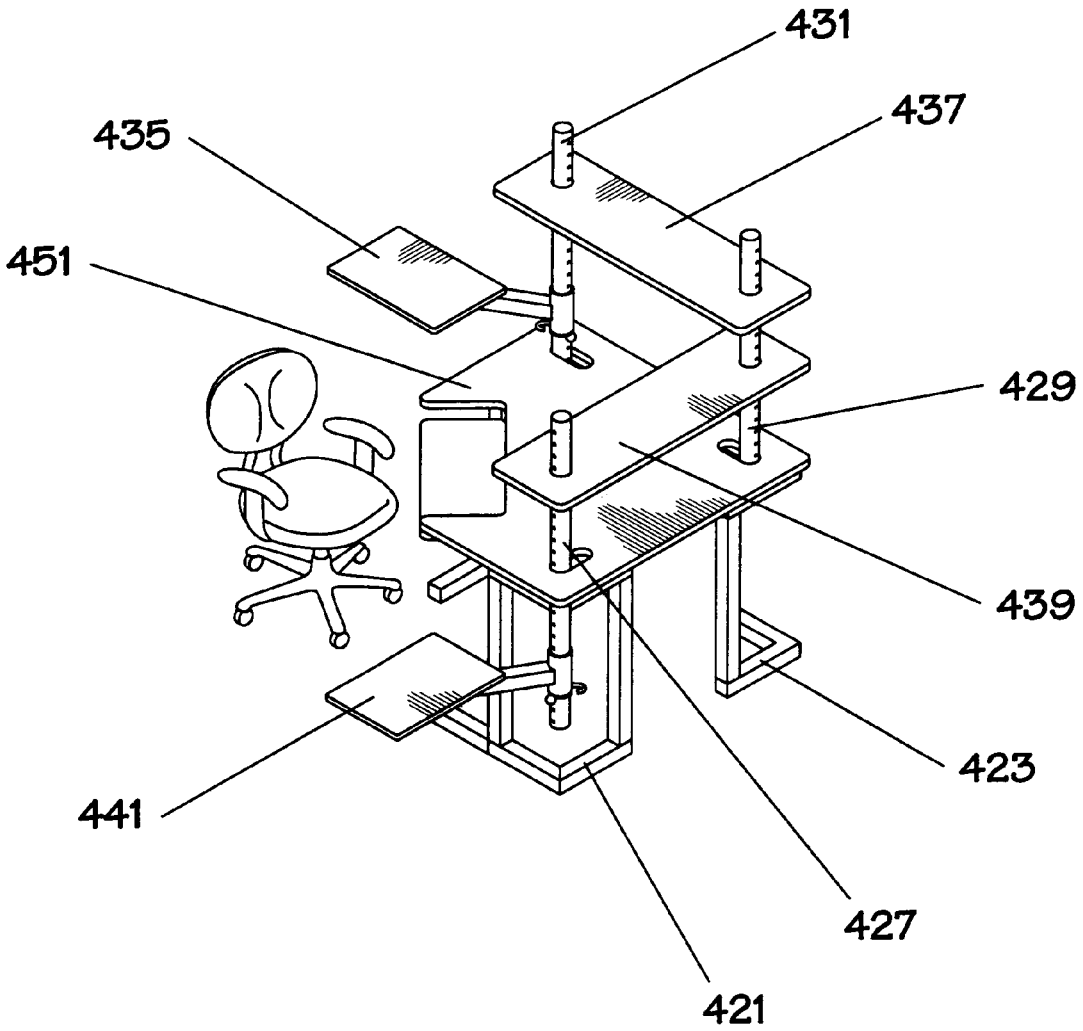
Figure 7C:
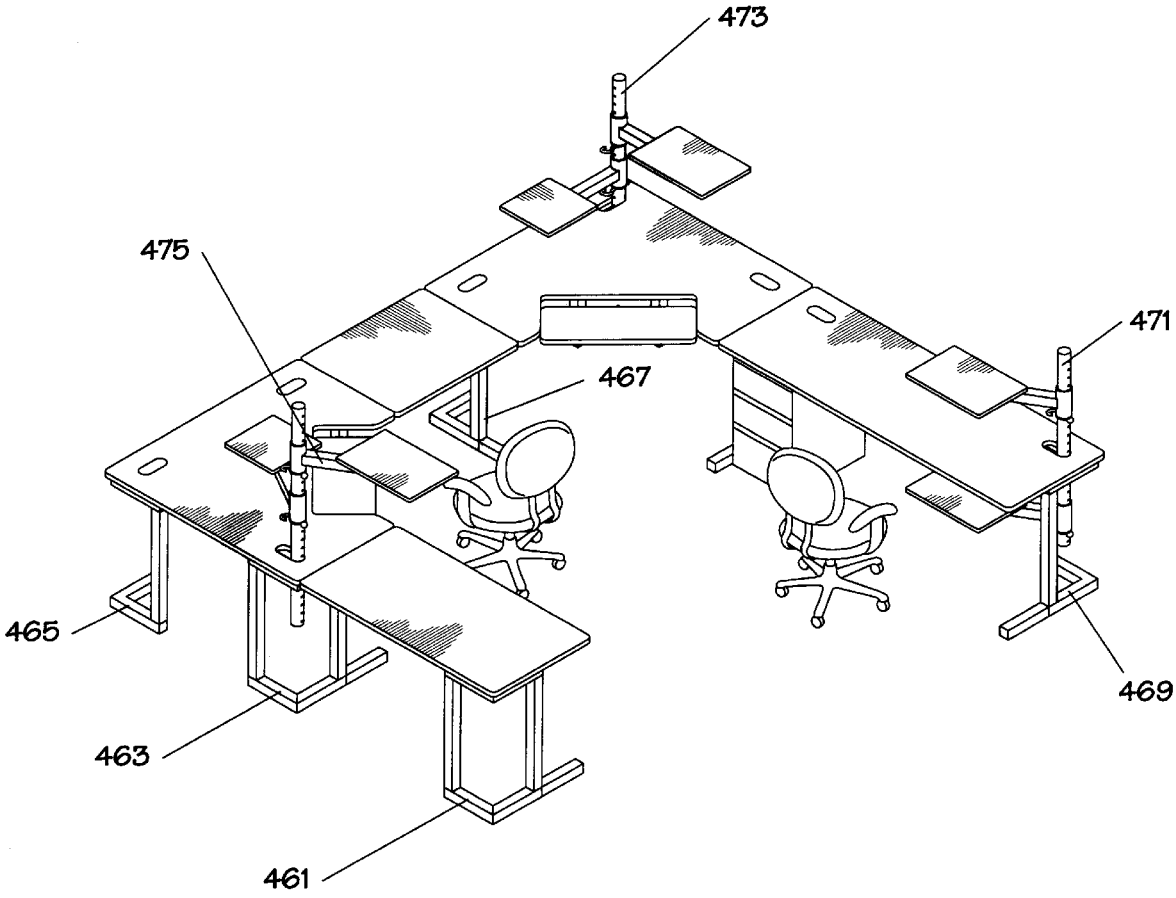

FIGS. 7*a*, 7*b* and 7*c* depict a variety of the numerous types of configurations which can be obtained utilizing the support apparatus of the present invention. As is shown in the view of FIG. 7*a*, corner base members 401, 403 may be utilized to support substantially vertical support poles 405, 407. A substantially planar work surface 409 is secured to the upper portion of the base members 401, 403 (including a horizontal tie member) which is obscured in the view of FIG. 7*a*). These substantially vertical support poles 405, 407 support shelf 411 which is load bearing. The loads provided through shelf 411 pass through substantially vertical support poles 405, 407 to the base members 401, 403, without loading substantially vertical work surface 409.

FIG. 7*b* depicts another embodiment of the support apparatus of the present invention. Modular corner frame members 421, 423, 425 in the view of FIG. 7b, modular corner frame member 425 is obscured, vertical support poles 427, 429, 431. A variety of support surfaces are suspended from these vertical support poles 427, 429, 431, including support arm 435, shelf 437, shelf 439 and support arm 441. As is shown in FIG. 7*b*, support arm 441 is placed low within this support unit, in fact below the work surface 451.

FIG. 7*c* depicts yet another configuration of the support apparatus of the present invention. As is shown, a plurality of modular corner frame members 461, 463, 465, 467 and 469 are utilized to support a plurality of substantially vertical support poles 471, 473, 475 which support a plurality of support arms which are adapted to support modular and cooperating components. A plurality of horizontal tie members connect the modular corner frame members and allow for support of, and connection of, the substantially planar work surfaces.

It will be appreciated that the present invention is modular and will support a variety of particular configurations.

Figure 10:
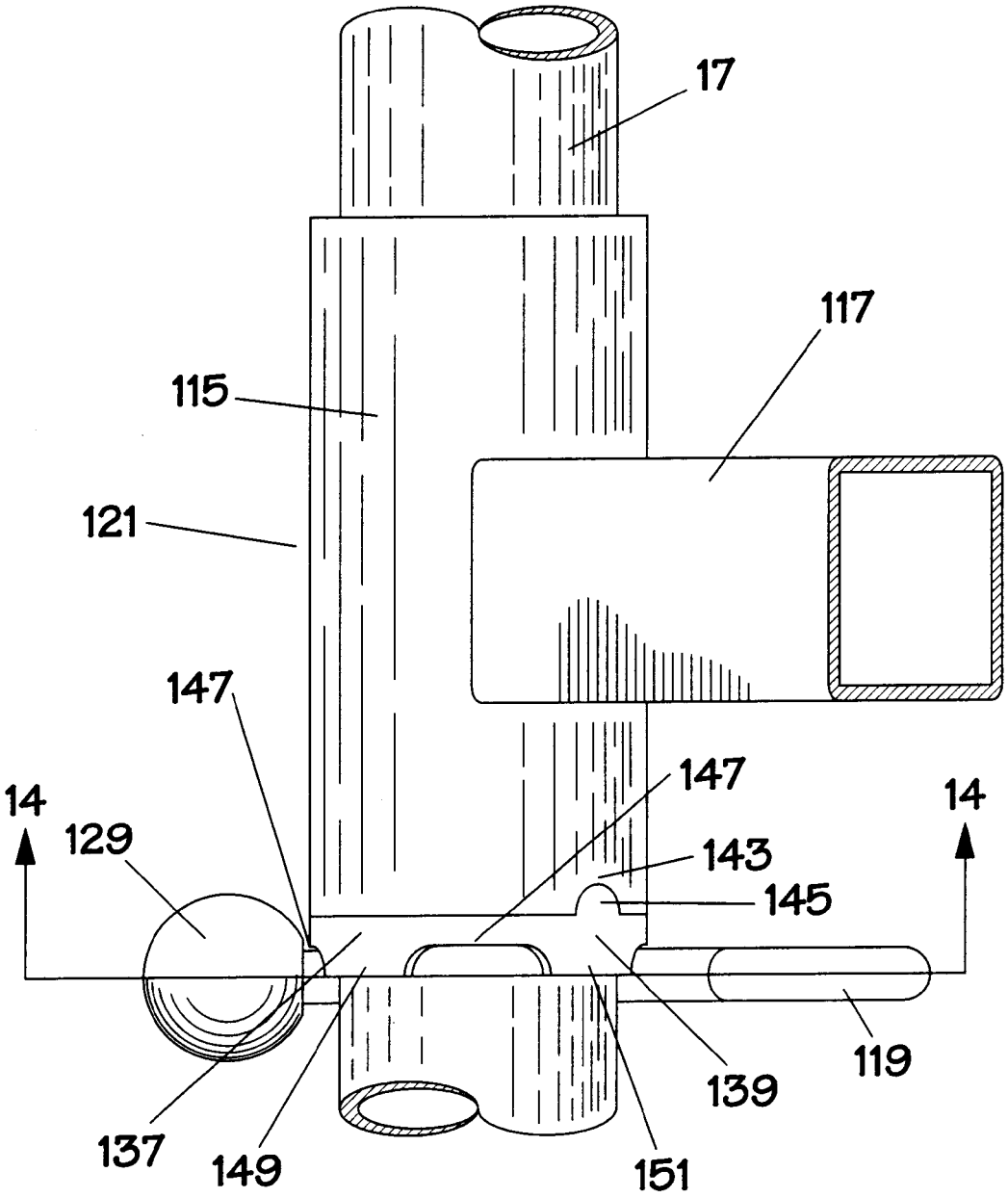
FIG. 10 is a perspective and fragmentary view of the support bushing, support arm, and support pole which are depicted in FIG 9.
Figure 11:
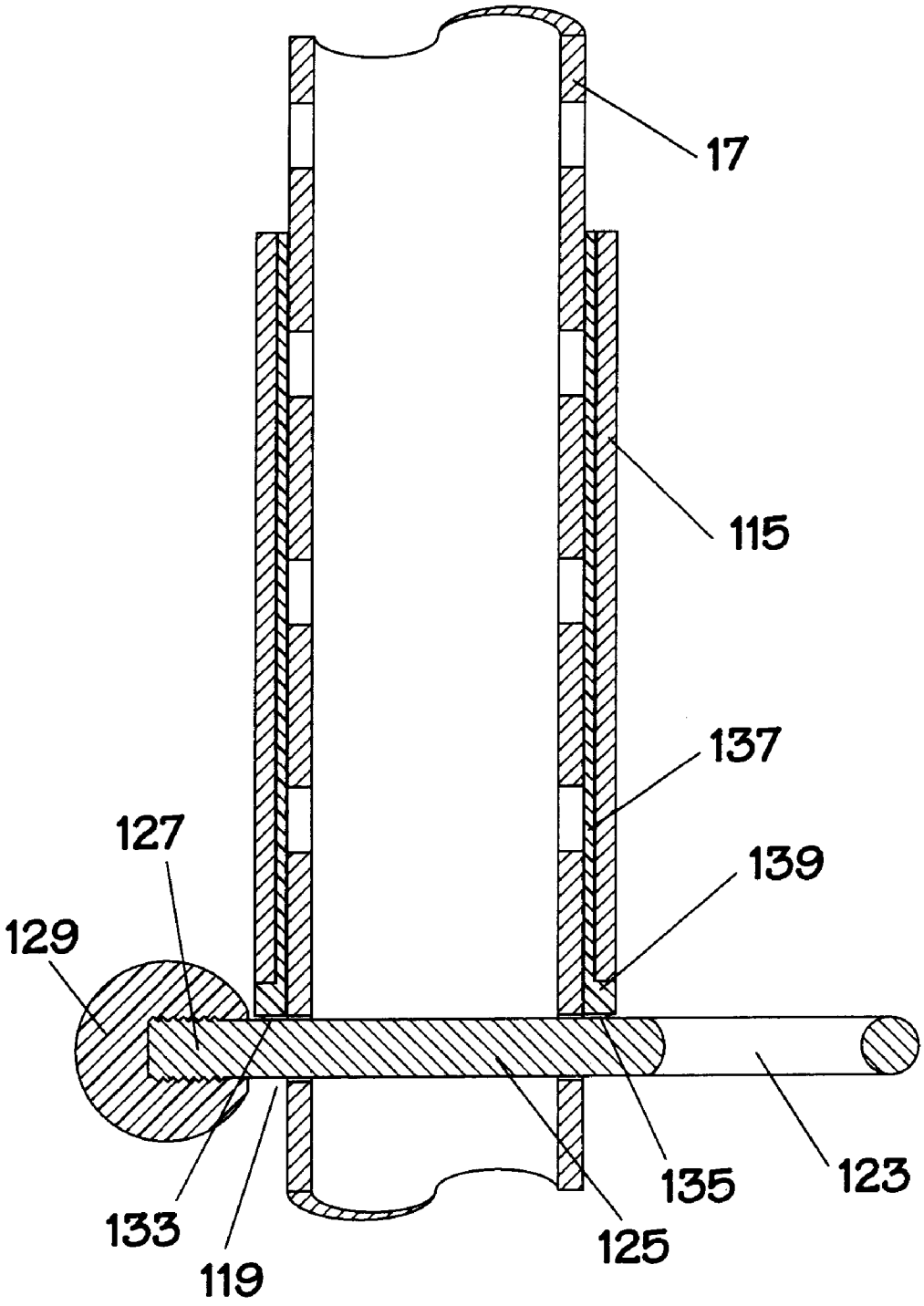
FIG. 11 is a longitudinal section view of the support bushing and support pole as seen along section line C—C of FIG. 9.
Figure 15A:
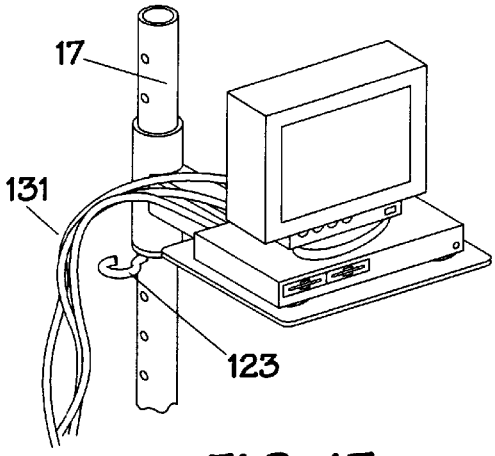
FIGS. 15*a*, 15*b*, and 15*c* depict the utilization of an eye bolt fastener to secure electrical cables which run between the various modular components of the computing equipment.
Figure 15B:
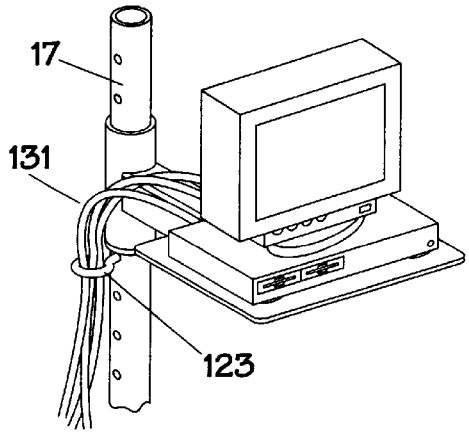

While the particular orientation of the latching cavities and the key-feed port determine the angular orientation of vertical support pole 17 relative to base assembly 13, the rotational freedom of the modular and cooperating components supported by the various support surfaces determined by the functional components of the bushing members which circumferentially engage vertical support pole 17 at particular axial locations, as will now be described with particular reference to FIGS. 8, 9, 10, and 11. As is shown in these figures, bushing 121 includes hub portion 115 which includes a central cylindrical bore 114 which is adapted to receive vertical support pole 17. As is shown in these figures, hub portion 115 is secured to support arm 117 which extends radially outward therefrom. Bushing 121 further includes hub pin 119 which includes an eyelet portion 123, a load bearing portion 125, and an externally threaded fastening portion which is adapted to mate with an internally threaded hub pin retainer member 129 which prevents the inadvertent or accidental removal of hub pin 119 from vertical support pole 17. As is best depicted in FIGS. 15*a* and 15*b*, eyelet portion 123 of hub pin 121 is utilized to secure conductors which extend between the various modular and cooperating components in a secure position relative to vertical support pole 17. Returning now to FIG. 11, load-bearing portion 125 of hub pin 119 is utilized to maintain hub portion 115 in a fixed axial position relative to vertical support pole 17. Also, as is best depicted in FIG. 11, externally threaded fastening portion of hub pin 119 engages hub pin retainer member 129 to prevent hub pin 119 from being inadvertently removed from vertical support pole 17. As is best depicted in FIG. 11, a plurality of axially positioning holes, such as holes 133, 135 of FIG. 11 are adapted in size to receive load bearing portion 125 of hub pin 119. In this configuration, hub portion 115 bears down upon load bearing portion 125 of hub pin 119.

Figure 8:
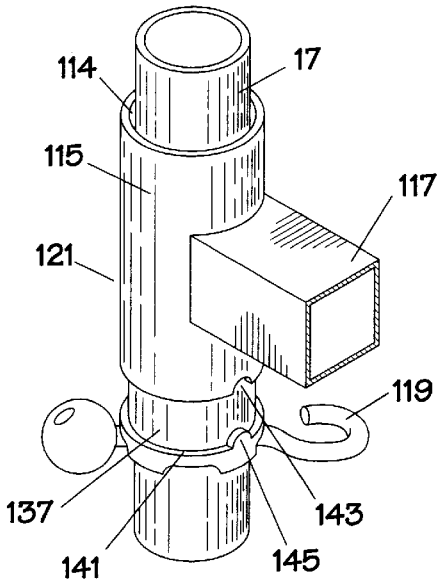
FIG. 8 is a depiction of the castellation the support bushing of FIGS. 11, 12, and 13, which define the range of rotation of the support arm.
Figure 9:
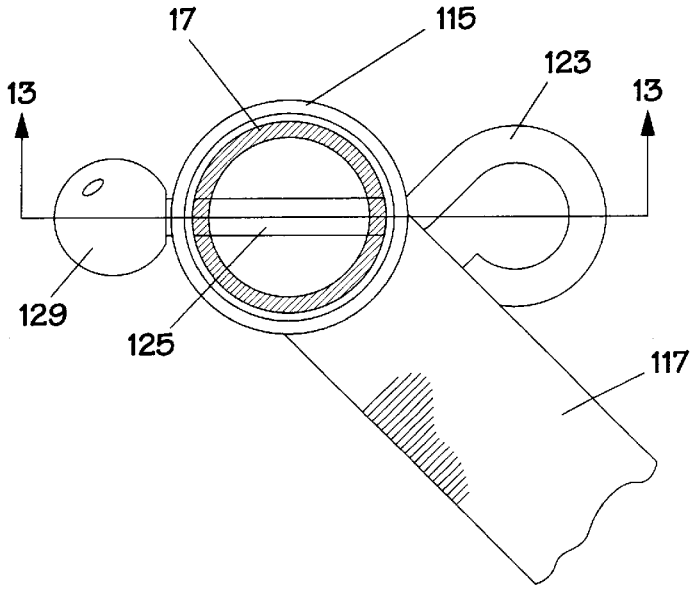
FIG. 9 is a detail view of an arm bushing which couples a support arm to the support pole in the support apparatus depicted in FIG. 1, seen in cross-section.

In the preferred embodiment of the present invention, bushing 121 further includes a bushing insert 137 which is preferably formed of plastic, and which includes a radially reduced portion 139 which is adapted to slide inward of hub portion 115 and be disposed in the space between vertical support pole 17 and interior cylindrical surface 114 of hub 115, and radially enlarged and contoured lower portion 141. A female mating notch is provided on the lower lip of hub portion 115, while a male mating notch 145 is provided on the radially-enlarged contoured portion of bushing insert 137. When these male and female mating portions are aligned, bushing insert 141 is in its proper alignment relative to hub portion 115. In FIG. 8, bushing insert 137 is depicted slightly retracted from the interior cylindrical bore 114 of hub portion 115 of bushing 121; however, in the view of FIG. 10, the male and female portions are depicted as mating, thus indicating a proper orientation of bushing insert 131 relative to hub portion 115. As is best shown in FIG. 10, radially-enlarged contoured portion 139 of bushing insert 137 includes a range limiting portion 147 for slidably engaging hub pin 119 over a preselected acceptable range of rotation, with the range limiting portion being defined between stop members, such as stop members 149, 151 of FIG. 10 which prevent further rotation of bushing 121.

Figure 12C:
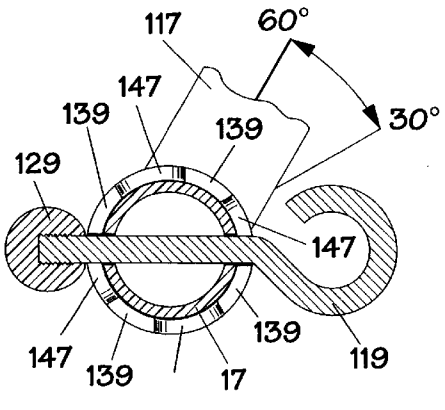
FIGS. 12*a*, 12*b*, and 12*c* depict the utilization of the castellation of the support bushing to provide a restricted range of movement of the associated support arm.
Figure 12B:
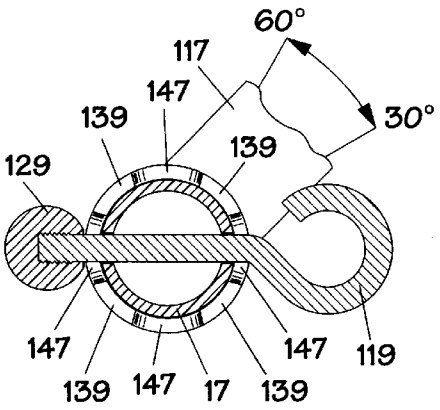
Figure 12A:
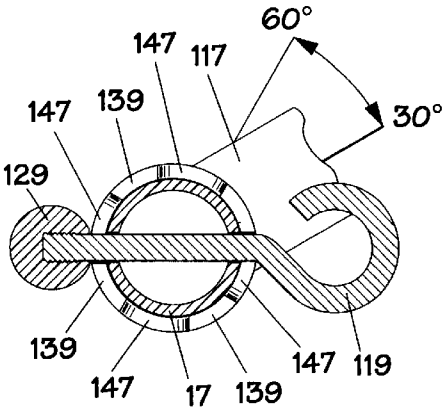

The one possible configurations are best depicted in the views of FIGS. 12*a*, 12*b*, 12*c*, 13*a*, 13*b*, and 14. The views of FIGS. 12*a*, 12*b*, 12*c*, depict hub pin 119 cooperating with crenellations or range limiting portions 147 in lower enlarged portion 139 of bushing insert 137. FIGS. 12*a* through 12*c* illustrate range limiting portions 147 arranged to provide a 30° range of motion. FIG. 12*a* illustrates support arm 117 at a 30° orientation relative to vertical support pole 17. In this 30° position, hub pin 119 abuts the end walls of range limiting portions 147 in lower portion 139 of bushing insert 137. FIG. 12*b* illustrates support arm 117 in an intermediate position in which hub pin 119 is intermediate the end walls of range limiting portion 147. FIG. 12*c* illustrates support arm 117 in a 60°position in which hub pin 119 abuts the end walls of range limiting portions 147 opposite from those abutted in the 30° position illustrated in FIG. 12*a*. Thus, FIGS. 12*a* through 12*c* illustrate a pattern of crenellations or range limiting portions 147 that restrict movement of support arm 117 to a 30° range of motion.

Figure 13B:
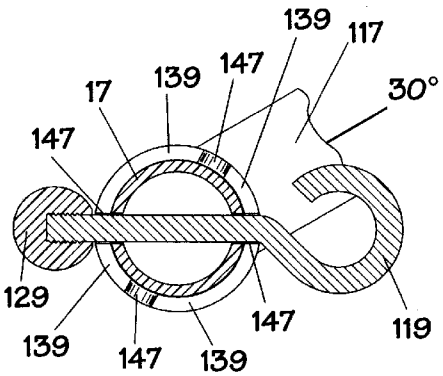
FIGS. 13*a* and 13*b* depict another utilization of the castellation of the support bushing to provide at least a pair of fixed positions of the associated support arm.
Figure 13A:
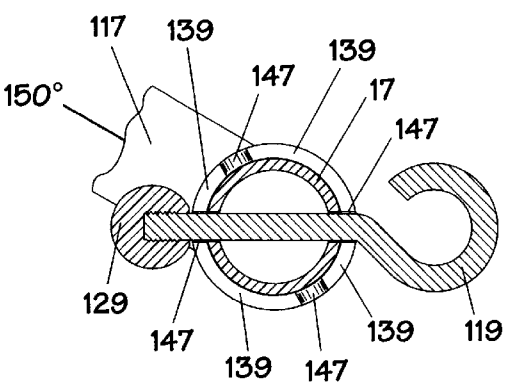

FIGS. 13*a* and 13*b* represent an embodiment of the present invention in which lower end 139 of bushing insert 137 is provided with two pairs of crenellations or range limiting portions 147 that are dimensioned to be coextensive with the diameter of hub pin 119. Thus, two fixed positions of support arm 117, a 150° position and a 30° position are selectable, depending on which pair of range limiting portions 147 engage hub pin 119. In this arrangement, support arm 117 is not freely movable but occupies one of two fixed positions defined by range limiting portions 147. Of course, any number of fixed positions may be selected, limited only by the ability to provide lower end 139 of bushing insert 137 with range limiting portions 147.

Figure 14:
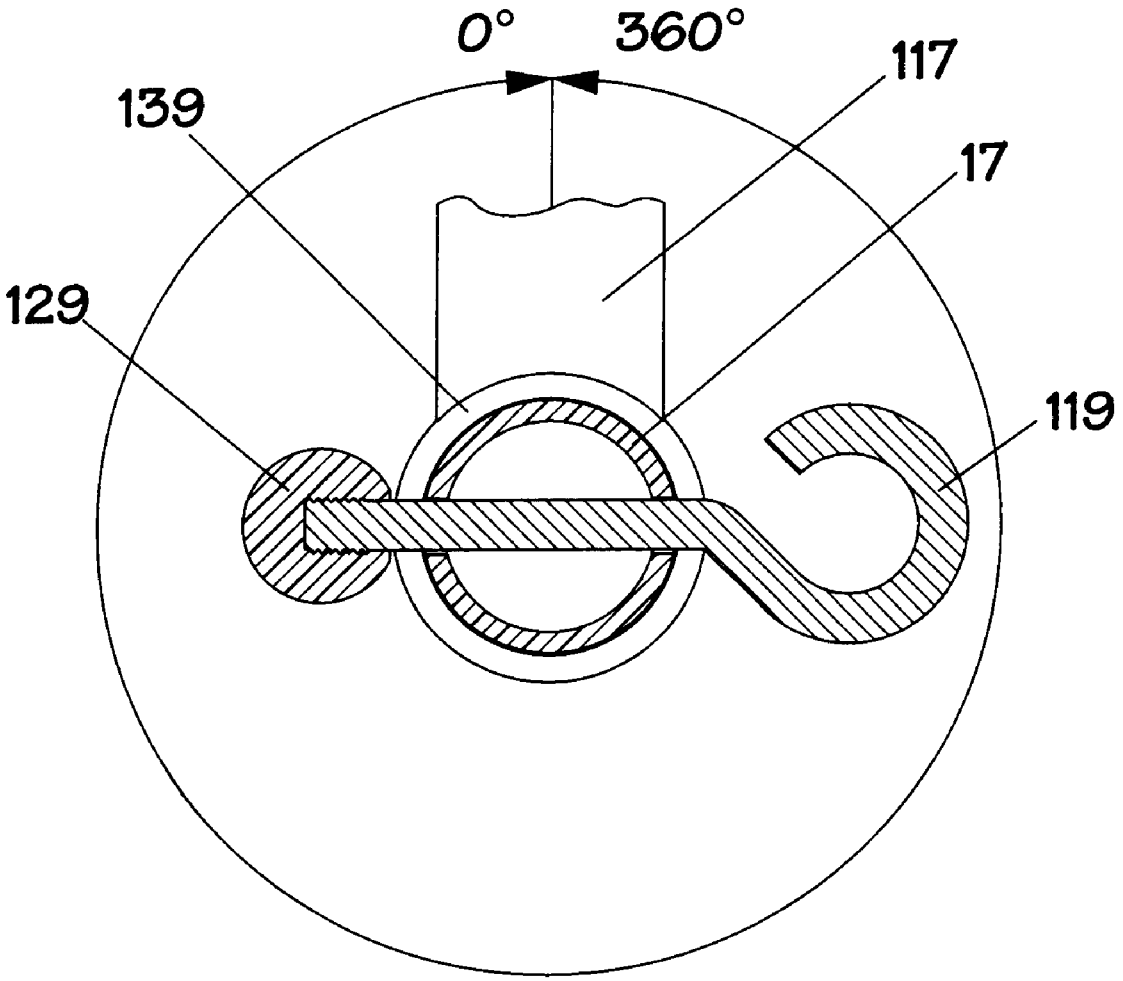
FIG. 14 depicts the utilization of no castellation on the support bushing to provide an unlimited range of movement of the associated support arm.

FIG. 14 depicts an arrangement in which lower end 139 of bushing insert 137 is smooth and provided with no range limiting portions. Thus, the arrangement illustrated in FIG. 14 provides for unrestricted movement of support arm 117 a full 360° around vertical support member 17. In this arrangement, hub pin 119 serves to maintain bushing 121 in a selected axial or vertical position relative to vertical support member 17.

FIGS. 12*a* through 14 illustrate various arrangements in which movement of support arm 117 about vertical support member 17.

Figure 15C:
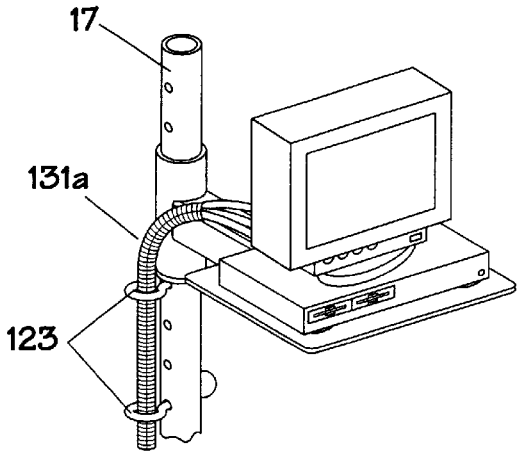

FIGS. 15*a*, 15*b*, and 15*c* illustrate the utility of eye portion 123 of hub pin 119 in securing cables 131, cords, and the like of equipment supported by the apparatus according to the present invention. As shown in FIG. 15*b*, cords 131 can be secured within eye portion 123 of support hub pin 119 to prevent tangling and catching of cables 131 on other equipment or the apparatus itself. FIG. 15*c* illustrates an alternative arrangement in which the cords are first bundled utilizing a sheathing member 131*a* prior to securing the cables in the hook portions of hub pins 119.

Figure 16:
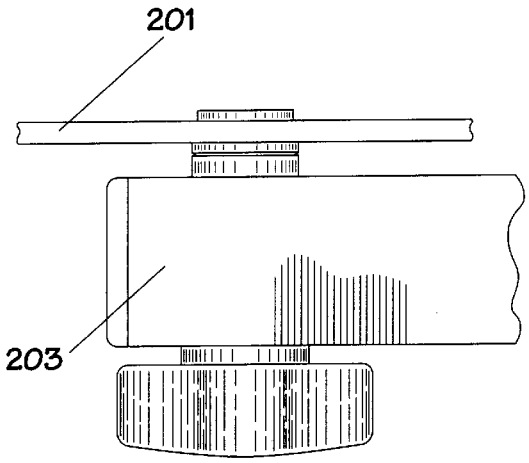
FIG. 16 is a detail view of a portion of FIG. 1, depicting a coupling of a support arm and a support shelf of the support apparatus.
Figure 17:
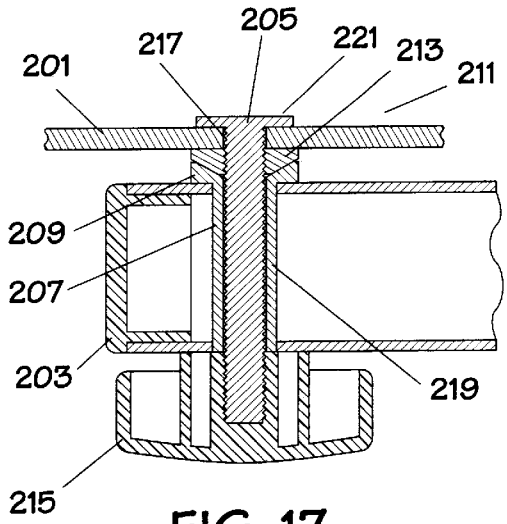
FIG. 17 is a cross-section view of the detail view of FIG. 16.
Figure 18:
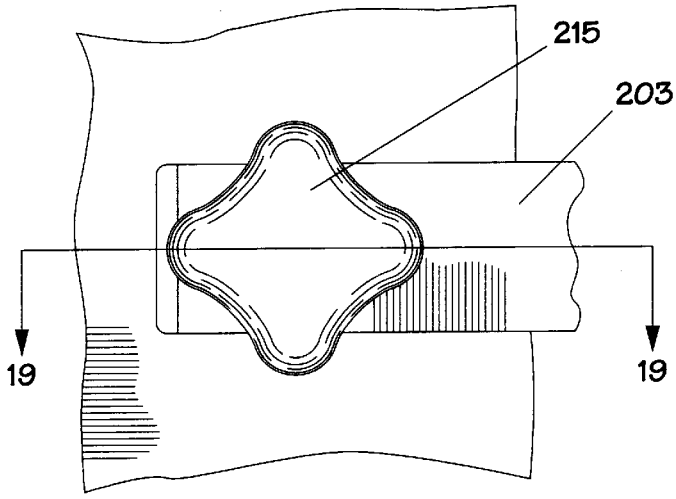
FIG. 18 is a view from the bottom of the detail view of FIG. 16.

FIGS. 16, 17, and 18 depict support surface 201, support arm 203, and pivotal coupling 211 which includes externally threaded bolt 205, internally threaded sleeve 207 with beveled seating head 209, beveled seating washer 213, and locking member 215. A coupling bore 217 is provided in a central location in support surface 201. In the preferred embodiment of the present invention, support surface 201 comprises a low profile sturdy material, such as an aluminum plate. Internally threaded sleeve 207 is placed into bore 219 of support arm 203. Externally threaded bolt 205 serves as a coupling pin for securing support surface 201 to support arm 203 in a manner which allows 360° of rotation for support surface 201 relative to support arm 203. Locking member 205 is provided with a knob component and an internally threaded bore for engaging externally threaded bolt 205 and fixing the position of support surface 201 relative to support arm 203. Locking member 215 may be loosened or tightened depending upon the operator's desires for repositioning of the modular component supported by support surface 201. Since only a very unobtrusive bolt head 221 of externally threaded bolt 205 extends outward from support surface 201, the coupling mechanism 211 does not interfere with, or impede the operation of, the modular and cooperating component which is carried and supported by support surface 201. Since coupling bore 217 is disposed in a central location within support surface 201, an advantageous load bearing configuration is obtained so that pure bending forces are applied through support surface 201 to support arm 203 through a region of support surface 201 which substantially coincides with the center of gravity of the modular and cooperating component which is carried by support surface 201.

The male and female mating members defined by beveled head 209 and beveled washer 213 provide a means for slightly impeding the rotational movement of support surface 201 relative to support arm 203, which is especially useful in impeding vibration-induced rotational movement of support surface 201 relative to support arm 203 in response to highly kinetic equipment, such as impact printers. This male and female mating configuration allows for infinite rotational adjustability without presenting rotational instability.

While the invention has been shown in only one of its forms, it is not thus limited but is susceptible to various changes and modifications without departing from the spirit thereof.

What is claimed is:

1. An apparatus for supporting modular and cooperating components comprising:

(a) a base assembly for engaging a flooring surface;

(b) a substantially planar work surface with a support pole port formed therein;

(c) a substantially vertical support pole releasably coupled to said base assembly and extending upward from said substantially planar work surface;

(d) at least one bushing, concentrically engaging said substantially vertical support pole at a particular axial location;

(e) at least one support arm, extending radially outward from said at least one bushing at a particular orientation; and (f) at least one support surface, secured to said at least one support arm, said at least one support surface being positioned substantially orthogonal to said substantially vertical support pole and adapted for receiving and supporting said modular and cooperating components at particular axial and angular positions relative to said base member and said substantially vertical support pole.

2. An apparatus for supporting modular and cooperating components, according to claim 1, wherein said base assembly comprises:

a plurality of modular corner frame members;

a plurality of horizontal tie bars interconnecting said plurality of modular corner frame members;

a pole receptacle member coupled to a particular one of said modular corner frame members.

3. An apparatus for supporting modular and cooperating components according to claim 2, wherein each of said plurality of modular corner frame members comprise:

a upper horizontal frame member;

a lower horizontal frame member spaced apart from said upper horizontal frame member and substantially parallel therewith; and first and second spaced apart vertical frame members extending between said upper and lower horizontal frame members.

4. An apparatus for supporting modular and cooperating components, according to claim 3:

wherein said upper horizontal frame member includes first and second generally orthogonally positioned frame segments; and wherein said lower horizontal frame member includes first and second generally orthogonally positioned frame segments.

5. An apparatus for supporting modular and cooperating components, according to claim 4:

wherein said first and second generally orthogonally positioned frame segments come together at an apex portion;

wherein said first and second spaced apart vertical frame members extend between said upper and lower horizontal frame members at locations distally located from said apex portion of said upper and lower horizontal frame members, allowing relatively unrestricted access to said substantially vertical support pole.

6. An apparatus for supporting modular and cooperating components, according to claim 2:

wherein said plurality of modular corner frame members include a predetermined number of end portions with connection ports formed therein; and wherein said plurality of horizontal tie bars terminate in connection members for releasably mechanically coupling with said connection ports of said plurality of modular corner frame members.

7. An apparatus for supporting modular and cooperating components, according to claim 6:

wherein said plurality of modular corner frame members and said plurality of horizontal tie bars coupled together without requiring positive mechanical couplings therebetween during ordinary use.

8. An apparatus for supporting modular and cooperating components, according to claim 2:

wherein said pole receptacle member includes a pair of generally orthogonal connection flanges adapted in size to extend between particular orthogonal portions of a particular modular corner frame member.

9. An apparatus for supporting modular and cooperating components, according to claim 8, further including:

a plate member extending between said generally orthogonal connection flanges.

10. An apparatus for supporting modular and cooperating components, according to claim 9, further including:

a pole sleeve coupled to said plate and including a central bore adapted in size and shape to receive said substantially vertical support pole.

11. An apparatus for supporting modular and cooperating components, according to claim 1:

wherein said substantially planar work surface is connected directly to said base assembly;

wherein said base assembly directly supports all loading associated with said substantially vertical support pole; and wherein said substantially planar work surface does not support any portion of the loading associated with said substantially vertical support pole.

12. An apparatus for supporting modular and cooperating components, according to claim 1:

wherein said at least one bushing is rotatable relative to said substantially vertical support pole over a predetermined rotation range.

13. An apparatus for supporting modular and cooperating components, according to claim 1:

wherein said at least one bushing includes (a) a hub portion which is rotatable and which includes a central bore for concentrically receiving said substantially vertical support pole, and (b) a hub pin for maintaining said hub portion in a fixed axial position relative to said substantially vertical support pole.

14. An apparatus for supporting modular and cooperating components, according to claim 13:

wherein a lower portion of said hub portion engages said hub pin.

15. An apparatus for supporting modular and cooperating components, according to claim 14:

wherein said lower portion of said hub portion includes at least one contoured portion to define a predetermined range of permissible rotation for said hub portion.

16. An apparatus for supporting modular and cooperating components, according to claim 15:

wherein said at least one contoured portion comprises castellation which limits rotation of said hub portion to said predefined range of permissible rotation.

17. An apparatus for supporting modular and cooperating components, according to claim 13:

wherein said at least one bushing further includes (c) a bushing insert carried within said hub portion, which includes a particular contoured portion which limits rotation of said hub portion to a predefined range of permissible rotation for said hub portion.

18. An apparatus for supporting modular and cooperating components, according to claim 17:

wherein said contoured portion of said bushing insert slidably engages said hub pin over a predetermined region on said contoured portion of said bushing insert.

19. An apparatus for supporting modular and cooperating components, according to claim 13:

wherein said hub pin includes an eyelet portion for receiving and securing conductors which extend between said modular and cooperating components.

20. An apparatus for supporting modular and cooperating components, according to claim 13, further comprising:

a sheath for enclosing said conductors which extends between said modular and cooperating components.

21. An apparatus for supporting modular and cooperating components, according to claim 13:

wherein said hub portion further includes a contoured lower portion between stop members;

wherein said hub pin includes (a) an eyelet portion for receiving and securing conductors which extend between said modular and cooperating components, (b) a load bearing portion for engaging a lowermost portion of said hub portion and preventing downward axial displacement and (c) a range limiting portion for slidably engaging said contoured lower portion of said hub portion between said stop members to allow a predetermined range of rotational movement relative to said substantially vertical support pole.

22. An apparatus for supporting modular and cooperating components, according to claim 21:

wherein said hub portion includes a bushing insert which defines said contoured lower portion.

23. An apparatus for supporting modular and cooperating components, according to claim 13:

wherein each of said at least one bushing further includes (c) a bushing insert which is adapted to be inserted concentrically within said hub portion in a preselected orientation.

24. An apparatus for supporting modular and cooperating components, according to claim 13:

wherein said substantially vertical support pole includes a plurality of bushing station ports which extend therethrough and which define a plurality of possible axial positions for engagement of a selected one of said at least one bushing.

25. An apparatus for supporting modular and cooperating components, according to claim 24:

wherein, during installation, said hub pins inserted in a particular one of said plurality of bushing station ports, and said hub portion is lowered over said substantially vertical support pole into engagement with said hub pin.

26. An apparatus for supporting modular and cooperating components, according to claim 25:

wherein said hub portion is rotatable relative to said substantially vertical support pole over a range defined by interaction of said hub portion and said hub pin.

27. An apparatus for supporting modular and cooperating components, according to claim 26:

wherein said at least one bushing further include a bushing insert which is received by said hub portion; and wherein said at least one bushing is rotatable relative to said substantially vertical support pole over a range of rotation defined by interaction of said bushing insert and said hub pin.

28. An apparatus for supporting modular and cooperating components, according to claim 13:

wherein each of said at least one bushing further includes (c) a hub pin retainer member which prevents inadvertent removal of said hub pin.

29. An apparatus for supporting modular and cooperating components, according to claim 1:

wherein said at least one support surface is pivotally coupled to a selected one of said at least one support arm.

30. An apparatus for supporting modular and cooperating components, according to claim 29:

wherein said at least one support surface comprises a single piece of a relatively low profile but sturdy material.

31. An apparatus for supporting modular and cooperating components, according to claim 29:

wherein a pivotal coupling between said at least one support surface and said at least one support arm comprises:

a coupling bore extending through said at least one support surface at a central location;

a coupling pin extending through said coupling bore and securing said at least one support surface to said at least one support arm;

wherein said at least one support surface is fully rotatable relative to said at least one support arm.

32. An apparatus for supporting modular and cooperating components, according to claim 31, further comprising:

a locking member for fixing said at least one support surface in rotational orientation relative to said at least one support arm.

33. An apparatus for supporting modular and cooperating components, according to claim 32:

wherein said locking member includes an internally threaded locking knob for engaging an externally threaded portion of said coupling pin.

34. An apparatus for supporting modular and cooperating components, according to claim 29, further comprising:

male and female mating members coupled between said at least one support surface and said at least one support arm, for slightly impeding rotational movement and especially impeding vibration-induced rotational movement.

35. An apparatus for supporting modular and cooperating components comprising:

(a) a base assembly for engaging a flooring surface;

(b) a substantially planar work surface with a support pole port formed therein;

(c) a substantially vertical support pole extending upward from said substantially planar work surface;

(d) at least one support arm, extending radially outward from said substantially vertical support pole at a particular orientation; and (e) at least one support surface, secured to said at least one support arm, said at least one support surface being positioned substantially orthogonal to said substantially vertical support pole and adapted for receiving and supporting said modular and cooperating components at particular axial and angular positions relative to said base member and said substantially vertical support pole.

36. An apparatus for supporting modular and cooperating components, according to claim 35, wherein said base assembly comprises:

a plurality of modular corner frame members;

a plurality of horizontal tie bars interconnecting said plurality of modular corner frame members;

a pole receptacle member coupled to a particular one of said modular corner frame members.

37. An apparatus for supporting modular and cooperating components according to claim 36, wherein each of said plurality of modular corner frame members comprise:

a upper horizontal frame member;

a lower horizontal frame member spaced apart from said upper horizontal frame member and substantially parallel therewith; and at least one vertical frame member extending between said upper and lower horizontal frame members.

38. An apparatus for supporting modular and cooperating components, according to claim 37:

wherein said upper horizontal frame member includes first and second generally orthogonally positioned frame segments; and wherein said lower horizontal frame member includes first and second generally orthogonally positioned frame segments.

39. An apparatus for supporting modular and cooperating components, according to claim 38:

wherein said first and second generally orthogonally positioned frame segments come together at an apex portion;

wherein said at least one vertical frame members extend between said upper and lower horizontal frame members at locations distally located from said apex portion of said upper and lower horizontal frame members, allowing relatively unrestricted access to said substantially vertical support pole.

40. An apparatus for supporting modular and cooperating components, according to claim 36:

wherein said plurality of modular corner frame members include a predetermined number of end portions with connection ports formed therein; and wherein said plurality of horizontal tie bars terminate in connection members for releasably mechanically coupling with said connection ports of said plurality of modular corner frame members.

41. An apparatus for supporting modular and cooperating components, according to claim 40:

wherein said plurality of modular corner frame members and said plurality of horizontal tie bars coupled together without requiring positive mechanical couplings therebetween during ordinary use.

42. An apparatus for supporting modular and cooperating components, according to claim 36:

wherein said pole receptacle member includes a pair of generally orthogonal connection flanges adapted in size to extend between particular orthogonal portions of a particular modular corner frame member.

43. An apparatus for supporting modular and cooperating components, according to claim 42, further including:

a plate member extending between said generally orthogonal connection flanges.

44. An apparatus for supporting modular and cooperating components, according to claim 43, further including:

a pole sleeve coupled to said plate and including a central bore adapted in size and shape to receive said substantially vertical support pole.

* * * * *